US006089921A

United States Patent [19]

Chou

[11] Patent Number: 6,089,921

[45] Date of Patent: Jul. 18, 2000

[54] ELECTRIC ADAPTER

[76] Inventor: Jonie Chou, 9F-4, No. 232, Chung Ho Road, Chung Ho City,Taipei Hsien, Taiwan

[21] Appl. No.: 09/343,192

[22] Filed: Jun. 30, 1999

[51] Int. Cl.[7] ..... H01R 25/00

[52] U.S. Cl. ..... 439/640; 439/27; 439/490

[58] Field of Search ..... 439/640, 20, 21, 439/22, 27, 28, 18

[56] References Cited

U.S. PATENT DOCUMENTS

| | | | |
|---|---|---|---|
| 3,951,487 | 4/1976 | Waldbrook | 439/21 |
| 4,743,999 | 5/1988 | Hames | 361/56 |
| 5,775,921 | 7/1998 | Chou | 439/21 |
| 5,954,519 | 9/1999 | Hsiao | 439/21 |
| 5,997,310 | 12/1999 | Chiu et al. | 439/21 |
| 6,004,138 | 4/1976 | Harbertson | 439/32 |

*Primary Examiner*—Khiem Nguyen
*Assistant Examiner*—Son V. Nguyen
*Attorney, Agent, or Firm*—Dougherty & Troxell

[57] ABSTRACT

An electric adapter, which includes a casing holding first and second metal contact frames for receiving the two metal blades of an electric plug being inserted into parallel insertion slots at the casing, a bottom cover covered on the casing, a rotary cap mounted in a through hole at the bottom cover, first and second metal blade respectively fastened to the rotary cap and extended out of the rotary cap for insertion into two parallel insertion slots at an electric socket, the first metal blade having a rear end axially aligned with the center of the rotary cap and connected to the first metal contact frame, the second metal blade having a rear end constantly maintained in contact with an annular locating portion at one end of the second metal contact frame upon rotary motion of the rotary cap.

8 Claims, 4 Drawing Sheets

ELECTRIC ADAPTER

BACKGROUND OF THE INVENTION

The present invention relates to an electric adapter for connecting an electric plug or power adapter to an electric outlet, and more particularly to such an electric adapter which comprises a fixed receptacle unit for receiving an electric plug or power adapter, and a rotary plug unit for connection to an electric outlet at the desired angle.

Regular electric home appliances and office automation apparatus are commonly worked with AC power supply. However, certain electric apparatus are designed to work with DC power supply. In order to convert AC power supply to DC power supply for an electric apparatus which consumes DC power supply, a power adapter shall be used. Further, when several electric apparatus are used, an extension cable may be necessary to connect installed electric apparatus to a common electric wall outlet. However, because the receptacle units of the electric outlet at an extension cable are arranged closed to one another, two power adapters cannot be installed in two adjacent receptacle units in the electric outlet of an extension cable. In this case, the application of the extension cable is limited.

SUMMARY OF THE INVENTION

The present invention has been accomplished under the circumstances in view. According to one aspect of the present invention, the electric adapter comprises a casing holding first and second metal contact frames for receiving the two metal blades of an electric plug being inserted into parallel insertion slots at the casing, a bottom cover covered on the casing, a rotary cap mounted in a through hole at the bottom cover, first and second metal blade respectively fastened to the rotary cap and extended out of the rotary cap for insertion into two parallel insertion slots at an electric socket, the first metal blade having a rear end axially aligned with the center of the rotary cap and connected to the first metal contact frame, the second metal blade having a rear end constantly maintained in contact with an annular locating portion at one end of the second metal contact frame upon rotary motion of the rotary cap. According to another aspect of the present invention, a surge protector is installed in the casing and connected between the two metal contact frames to absorb surge waves. According to the present invention, when two electric adapters are installed in two adjacent receptacle units at the electric outlet of an extension cable, the rotary cap at each electric adapter is respectively rotated to such a position that two power adapters can be respectively installed in the electric adapter without hindering each other.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
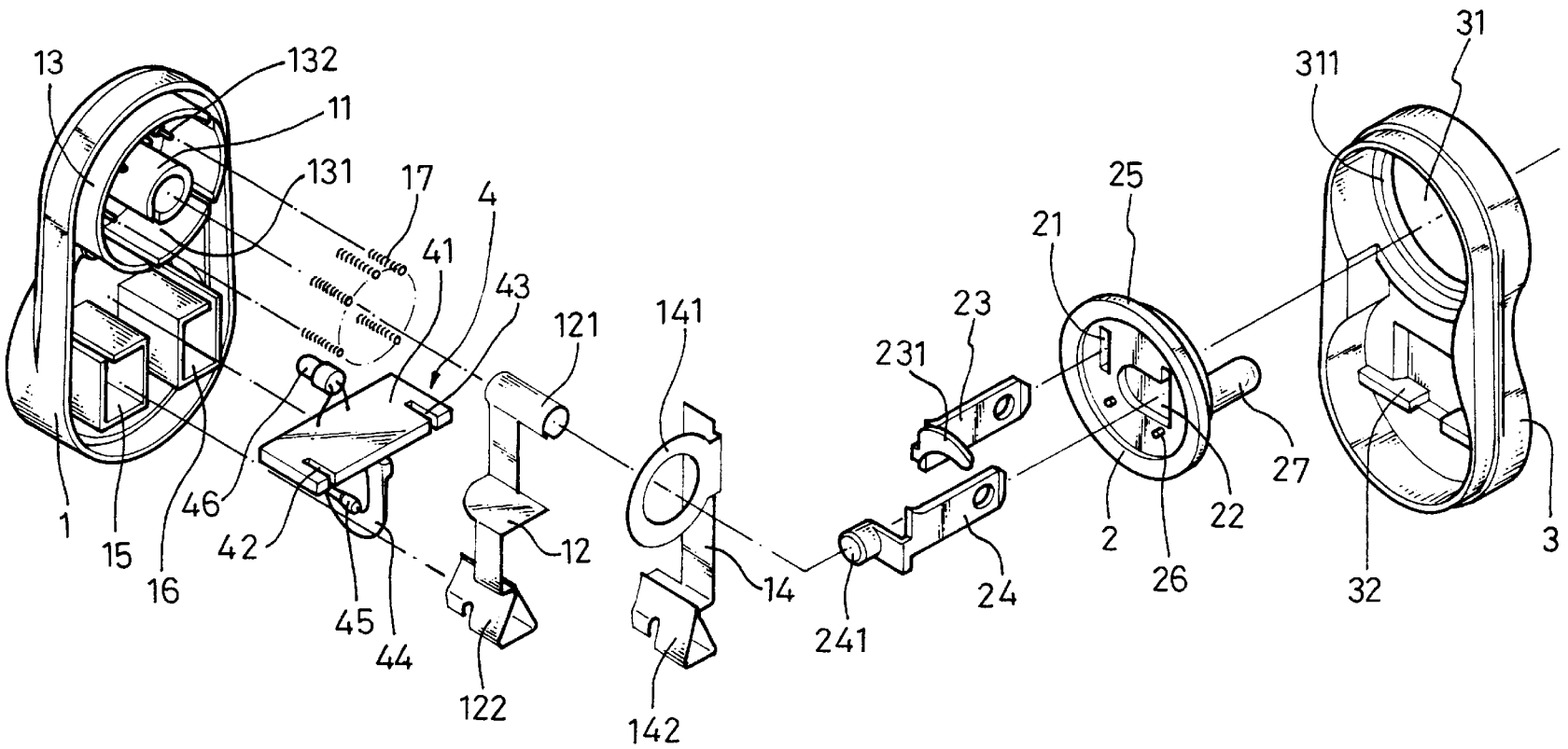
FIG. 1 is an exploded view of an electric adapter according to the present invention.
Figure 2:
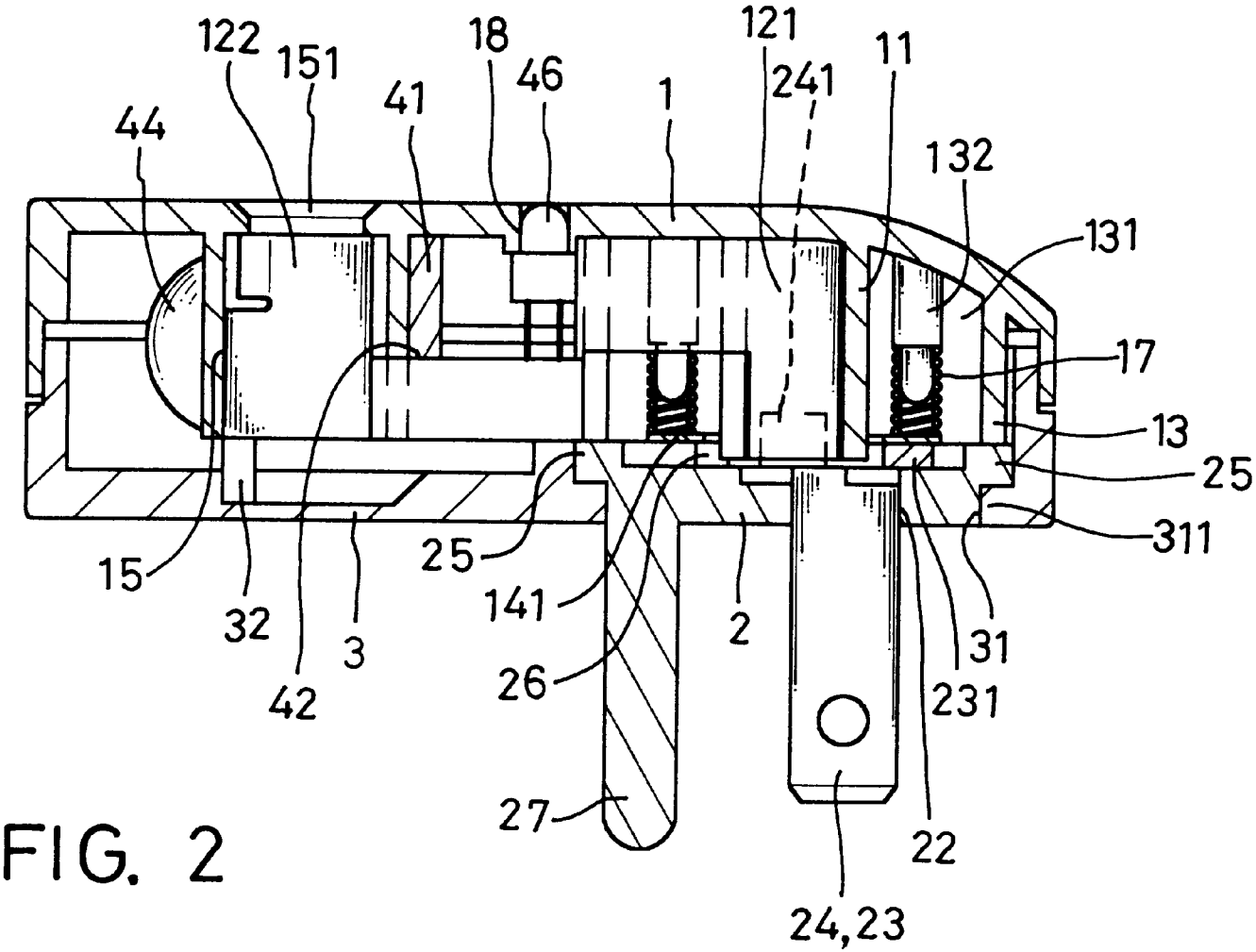
FIG. 2 is a sectional assembly view of the electric adapter according to the present invention.
Figure 3:
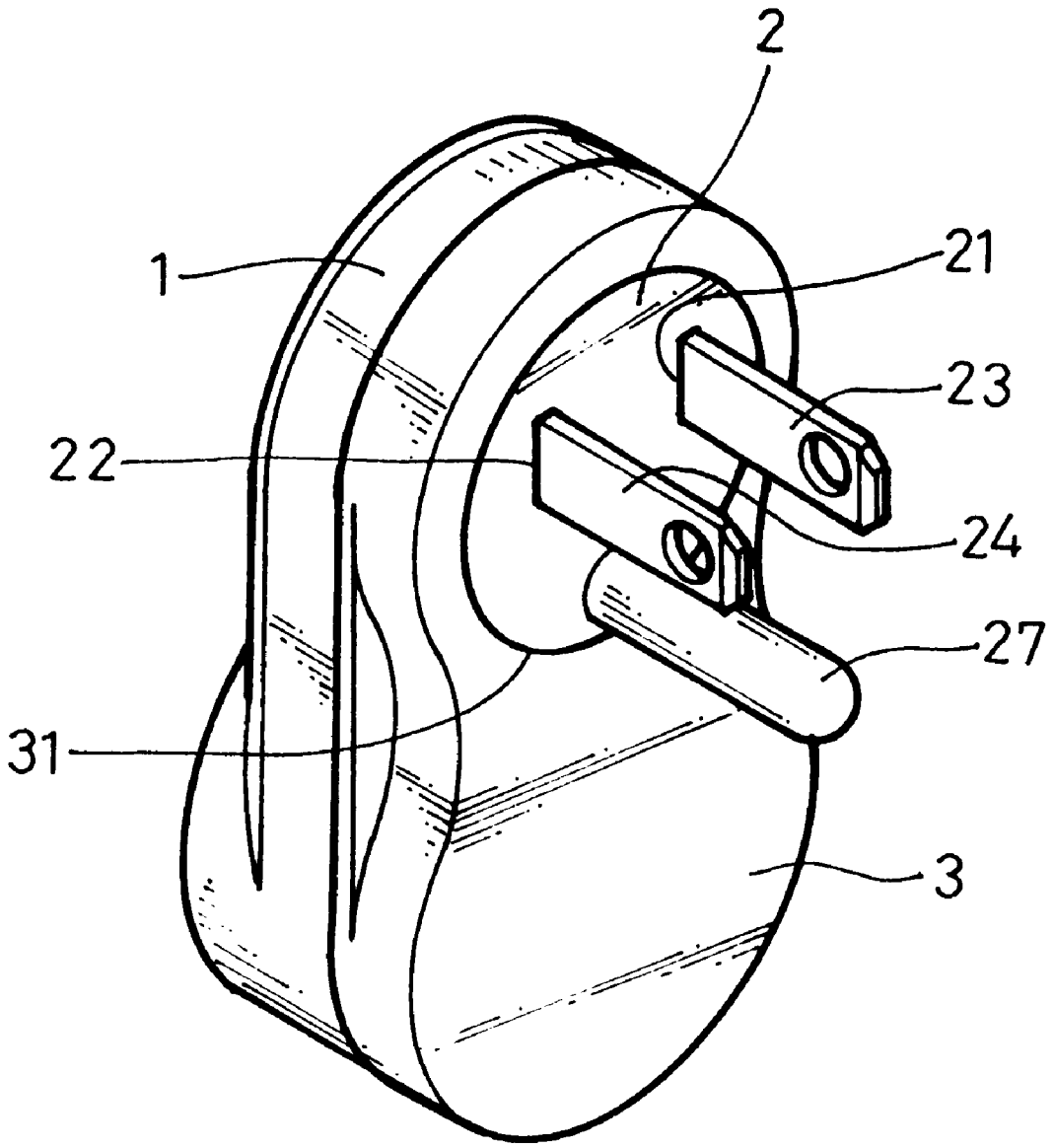
FIG. 3 is an elevational view of the electric adapter according to the resent invention.

Referring to Figures from 1 through 4, an electric adapter in accordance with the present invention is shown comprised of a casing 1, a first metal contact frame 12, a second metal contact frame 14, a first metal blade 24, a second metal blade 23, a rotary cap 2, a bottom cover 3, and a surge protector 4.

The casing 1 is a flat, hollow, insulation member comprising an upright tube 11 raised from its inside wall near one end, an upright annular flange 13 raised from its inside wall around the upright tube 11, an annular receiving chamber 131 defined within the upright annular flange 13 around the upright tube 11, a plurality of upright support rods 132 respectively raised from its inside wall and equiangularly spaced around the upright tube 11 within the annular receiving chamber 131, a first trough 15 and a second trough 16 arranged in parallel on the inside outside the upright annular flange 13, a first insertion slot 151 and a second insertion slot 152 respectively disposed in communication with the first trough 15 and the second trough 16, and a indicator hole 18. The first insertion slot 151 and the second insertion slot 152 are arranged in parallel for receiving the positive and negative metal contact blades of an electric plug. Further, a plurality of compression springs 17 are respectively mounted on the upright support rods 132. Further, the two distal ends of the casing 1 each have a smoothly arched periphery.

The rotary cap 2 is a circular insulation cap comprising a first through hole 22 and a second through hole 21 arranged in parallel, an outward coupling flange 25 raised around the periphery for coupling to the bottom cover 3, and a plurality of pressure rods 26 raised from its inside wall. Further, a grounding prong 27 is formed integral with the rotary cap 2.

The bottom cover 3 is covered on the casing 1 to hold the rotary cap 2 in place, comprising a circular through hole 31 near its one end corresponding to the annular receiving chamber 131, a coupling groove 311 provided on its inside wall around the circular through hole 31, which receives the outward coupling flange 25 of the rotary cap 2, for enabling the rotary cap 2 to be rotated in the circular through hole 31, and two pressure bars 32 raised from its inside wall corresponding to the troughs 15 and 16 at the casing 1. Further, the two distal ends of the bottom cover 3 each have a smoothly arched periphery.

The first metal contact frame 12 is mounted inside the casing 1 and inserted through a split at the first trough 15, a split at the upright annular flange 13 and a split at the upright tube 11, having one end terminating in a tubular receiving portion 121 disposed in the upright tube 11, and an opposite end terminating in a contact portion 122 disposed in the first trough 15 corresponding to the first insertion slot 151 and held down by one pressure bar 32 of the bottom cover 3.

The second metal contact frame 14 is mounted inside the casing 1 and inserted through a split at the second trough 15, a split at the upright annular flange 13 and a split at the upright tube 11, having one end terminating in a annular locating portion 141 supported on the compression springs 17 at the upright support rods 132 in the annular receiving chamber 131 around the upright tube 11, and an opposite end terminating in a contact portion 142 disposed in the second trough 16 corresponding to the second insertion slot 161 and held down by one pressure bar 32 of the bottom cover 3.

The first metal blade 24 is fastened to the first through hole 22 at the rotary cap 2 and extended out of the front side of the rotary cap 2 for insertion into one insertion slot at an electric socket, having a rear end terminating in a positioning rod 241 and fastened to the tubular receiving portion 121 of the first metal contact frame 12.

The second metal blade 23 is fastened to the second through hole 21 at the rotary cap 2 and extended out of the front side of the rotary cap 2 for insertion into one insertion slot at an electric socket, having a rear end terminating in a contact tip 231 disposed in contact with the annular locating portion 141 of the second metal contact frame 14.

The surge protector 4 comprises a circuit board 41 mounted in the casing 1 between the upright annular flange 13 and the troughs 15 and 16, a first contact notch 42 which receives the first metal contact frame 12, a second contact notch 43 which receives the second metal contact frame 14, a surge absorber 44, an overvoltage protection fuse 45, and an indicator light 46. The surge absorber 44, the overvoltage protection fuse 45 and the indicator light 46 are installed in the circuit board 41. Further, the indicator light 46 is received in the indicator hole 18 at the casing 1 to indicate normal operation of the surge protector 4.

Figure 4:
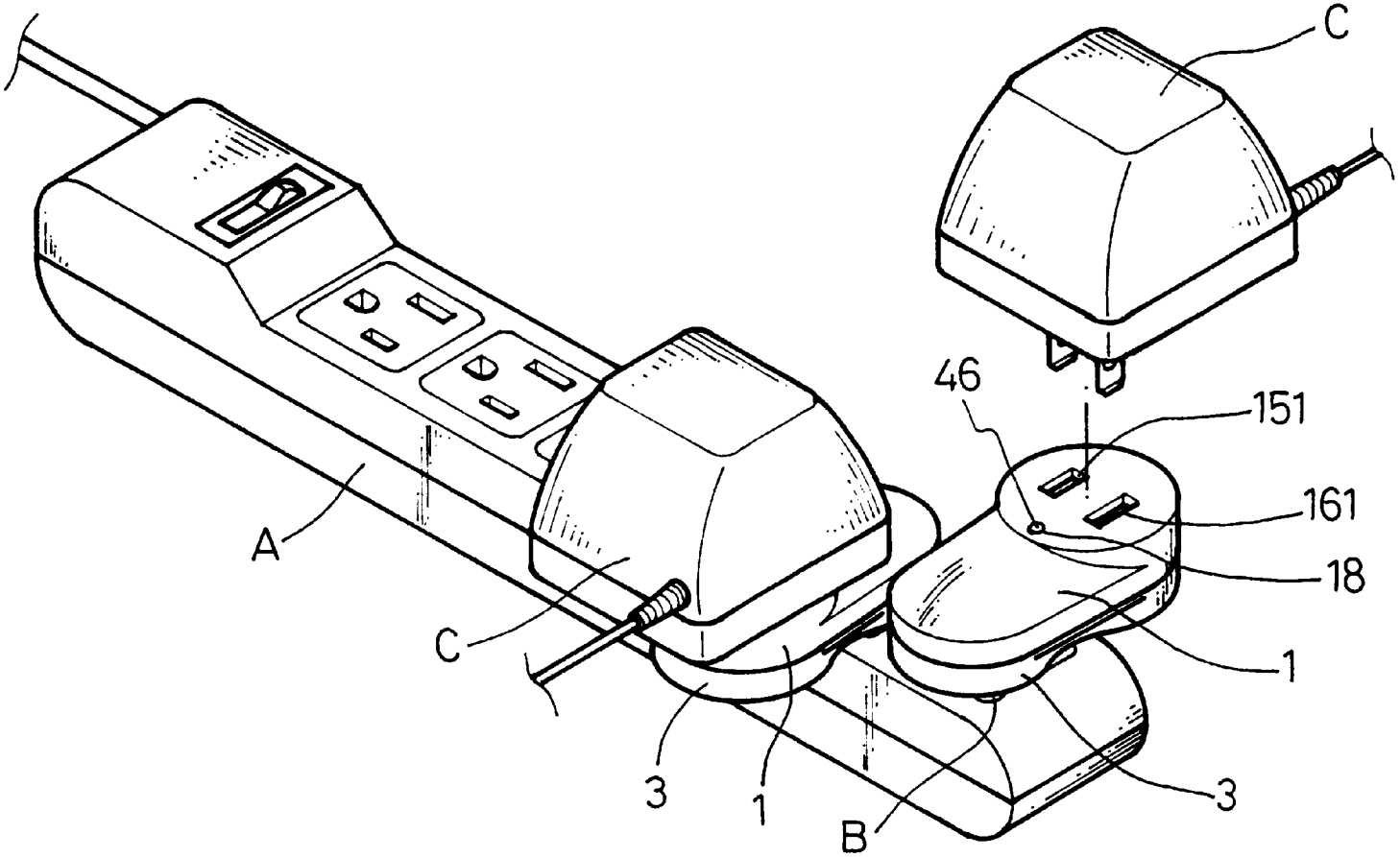
FIG. 4 shows an application example of the present invention.

FIG. 4 shows an application example of the present invention. As illustrated, when two electric adapters are used to connect two AC-to-DC power adapters C to two adjacent receptacle units B at an electric outlet A, the rotary cap 2 at each electric adapter is respectively rotated, so that the two AC-to-DC power adapters C do not interfere with one another.

While only one embodiment of the present invention has been shown and described, it will be understood that various modifications and changes could be made thereunto without departing from the spirit and scope of the invention disclosed.

What the invention claimed is:

1. An electric adapter comprising:

a flat, hollow, insulation casing, said casing comprising an inside wall, an upright tube raised from said inside wall at one end, an upright annular flange raised from said inside wall around said upright tube, an annular receiving chamber defined within said upright annular flange around said upright tube, a plurality of upright support rods respectively raised from said inside wall and equiangularly spaced around said upright tube within said annular receiving chamber, a first trough and a second trough formed on said inside wall and arranged in parallel outside said upright annular flange, a first insertion slot and a second insertion slot respectively disposed in communication with said first trough and said second trough for receiving the positive and negative metal contact blades of an electric plug, and, and a indicator hole;

a first metal contact frame mounted inside said casing, said first metal contact frame having one end terminating in a tubular receiving portion longitudinally disposed in said upright tube, and an opposite end terminating in a contact portion disposed in said first trough corresponding to said first insertion slot;

a second metal contact frame mounted inside said casing, said second metal contact frame having one end terminating in a annular locating portion supported on the upright support rods in the annular receiving chamber inside said casing around said upright tube, and an opposite end terminating in a contact portion disposed in said second trough corresponding to said second insertion slot;

a bottom cover covered on said casing to hold said first metal contact frame and said second metal contact frame inside said casing, said bottom cover comprising a circular through hole near one end thereof corresponding to said annular receiving chamber in said casing, and a coupling groove provided on an inside wall thereof around said circular through hole;

a rotary cap mounted in the circular through hole at said bottom cover, said rotary cap comprising a first through hole and a second through hole arranged in parallel, and an outward coupling flange raised around the periphery thereof and coupled to the annular groove at said bottom cover for enabling said rotary cap to be secured to said bottom cover and rotated in the circular through hole at said bottom cover; and a first metal blade and a second metal blade respectively fastened to the first through hole and second through hole at said rotary cap and extended out of said rotary cap for insertion into two insertion slots at an electric socket, said first metal blade having a rear end terminating in a positioning rod and fastened to the tubular receiving portion of said first metal contact frame, said second metal blade having a rear end terminating in a contact tip disposed in contact with the annular locating portion of said second metal contact frame and maintained in contact with the annular locating portion of said second metal contact frame upon rotary motion of said rotary cap.

2. The electric adapter of claim 1 wherein said casing and said bottom cover each have two opposite ends smoothly arched.

3. The electric adapter of claim 1 wherein said rotary cap comprises a grounding prong.

4. The electric adapter of claim 1 further comprises a plurality of spring members respectively mounted on the upright support rods in said casing to support the annular locating portion of said second metal contact frame.

5. The electric adapter of claim 1 wherein said rotary cover comprises a plurality of pressure rods respectively pressed on the annular locating portion of said second metal contact frame.

6. The electric adapter of claim 1 wherein said bottom cover comprises two pressure bars respectively pressed on the contact portion of said first metal contact frame and the contact portion of said second metal contact frame.

7. The electric adapter of claim 1 further comprises a surge protector connected between said first metal contact frame and said second metal contact frame, said surge protector comprising a circuit board mounted in said casing, and a surge absorber installed in said circuit board to absorb surge waves, said circuit board comprising a first contact notch which receives said first metal contact frame, and a second contact notch which receives the second metal contact frame.

8. The electric adapter of claim 7 wherein said surge protector further comprises an overvoltage protection fuse and an indicator light respectively installed in said circuit board, said indicator light being inserted into the indicator hole at said casing, and turned on when said overvoltage protection fuse is electrically connected, or turned off when said overvoltage protection fuse is broken due to an overvoltage.

* * * * *